US005553148A

United States Patent [19]

Werle

[11] Patent Number: 5,553,148

[45] Date of Patent: Sep. 3, 1996

[54] APPARATUS AND METHOD FOR PRODUCING VIBRATORY SENSATIONS TO ACCOMPANY AUDIBLE SOUNDS IN A PROPERLY PHASED RELATIONSHIP

[76] Inventor: Ben Werle, 4531 Aida Place, Woodland Hills, Calif. 91364

[21] Appl. No.: 261,800

[22] Filed: Jun. 20, 1994

[51] Int. Cl.[6] ..... H04R 5/02

[52] U.S. Cl. ..... 381/24; 381/151; 601/86; 601/90

[58] Field of Search ..... 601/86–95; 381/24, 381/151

[56] References Cited

U.S. PATENT DOCUMENTS

| | | | |
|---|---|---|---|
| 3,737,930 | 6/1973 | Smith, III | 5/348 WB |
| 4,175,297 | 11/1979 | Robbins et al. | 5/284 |
| 4,354,067 | 10/1982 | Yamada et al. | 381/24 |
| 5,190,033 | 3/1993 | Johnson | 128/403 |

*Primary Examiner*—Forester W. Isen
*Attorney, Agent, or Firm*—John J. Posta, Jr.

[57] ABSTRACT

An improved system and related method are disclosed for producing vibratory sensations on a listener's body which are similar to those experienced during a live performance, both in their vibratory nature and in their properly synchronized timing with the audible sounds which the listener is hearing at any given moment. The vibrations are imparted to the body of the listener by using a gel pack interposed between the body of the listener and a rigid or semi-rigid member on which a surface transducer is mounted, thereby providing an enhanced degree of coupling between the surface transducer and a relatively large area of the listener's body. The propagation of vibrations to the body of the listener is delayed using electronic circuitry interposed between a source of electronic signals and the surface transducer to allow the sound waves from a speaker to reach the ears of the listener at the same time that the vibrations are provided to the body of the listener.

2 Claims, 2 Drawing Sheets

APPARATUS AND METHOD FOR PRODUCING VIBRATORY SENSATIONS TO ACCOMPANY AUDIBLE SOUNDS IN A PROPERLY PHASED RELATIONSHIP

BACKGROUND OF THE INVENTION

Field of the Invention

The present invention relates generally to the field of sound reproduction, and more particularly to an improved system and related method for producing vibratory sensations on a listener's body which are similar to those experienced during a live performance, both in their vibratory nature and in their properly synchronized timing with the audible sounds which the listener is hearing at any given moment.

Electronic equipment for use in reproducing sound has improved dramatically with the quantum leaps made in the field of solid state electronics. Sound reproduction systems which are available today for even a modest price outperform the most elaborate and expensive systems of the recent past. When the listener closes his or her eyes, he or she can almost imagine that the sounds being listened to are not being electronically reproduced, but rather are occurring live in front (and indeed around) the listener. It is a fact that from the audible sound alone, it has become increasingly difficult to distinguish between a live performance and a digital recording reproduced on a high quality stereo system.

In fact, the only aspect distinguishing a live performance from such a high quality reproduction of the performance is not the sound, but rather is the "feel" of the live performance. By the term the "feel" it is meant that the vibratory aspects of a reproduced performance, even of a high quality reproduction, are just not the same. The "feel" of the sound on the listener's body is somehow different in a reproduced performance from the "feel" of the live performance of the same sounds in a manner which, while difficult to quantify, is nevertheless meaningful and significant.

The first assault on achieving the proper "feel" has resulted in the wide usage of subwoofers, which are able to better reproduce the low frequencies which digital recordings are able to record. Subwoofers move air, and are substantially nondirectional, and do result in an enhancement of the "feel" of a reproduced performance. However, they are limited in what they can achieve, and while having a subwoofer in a high quality sound reproduction system is better than not having a subwoofer in the same system, they still have not succeeded in capturing the proper "feel" of a live performance.

As might well be expected, the art is not without substantial efforts having been expended in the area of the reproduction of vibratory sensations which may be perceived by the body. In fact, the art is replete with devices for providing vibratory sensations to the body of an individual. While most of these references are not directly on point, it is nevertheless illuminating to briefly examine the art in this area.

Most of the references found in the art fall into one of two areas. The first of these two areas is the use of vibratory stimulation primarily for treatment in therapeutic applications; This area, while technically interesting, is less directly on point. The second of the areas, which is the more pertinent area, provides a vibratory stimulus to a listener in addition to providing a reasonable quality of audible sound reproduction.

The first of these areas is illustrated by U.S. Pat. No. 3,880,152, to Nohmura, U.S. Pat. No. 4,055,170, also to Nohmura, U.S. Pat. No. 4,813,403, to Endo, U.S. Pat. No. 5,035,235, to Chesky, U.S. Pat. No. 5,076,260, to Komatsu, U.S. Pat. No. 5,086,755, to Schmid-Eilber, and U.S. Pat. No. 5,101,810, to Skille et al. The two Nohmura references, the Schmid-Eilber reference, and the Skille et al. reference are all lounge chairs having speakers built into the chairs to provide therapeutic vibration in addition to music. All four are cited as promoting health through relaxation of the body.

The Chesky reference teaches a table rather than a lounge chair, but also has speakers built in for providing therapeutic vibration to a patient lying on the table. The Endo device uses a speaker to generate a vibratory sensation which is transmitted through a closed gas space to a vibratory member used to stimulate the human body. Finally, the Komatsu reference teaches an elaborate control system for generating a plurality of different types of vibratory signals. It is noteworthy that none of the devices in this first group are for use in addressing the problem discussed herein, namely producing a desired vibratory sensation to a listener in accompaniment with an audible signal.

The second area mentioned above is that of the systems which produce reasonable quality sound in addition to producing a vibratory stimulus. This area is illustrated by U.S. Pat. No. 4,023,566, to Martinmaas, U.S. Pat. No. 4,967,871, to Komatsubara, and U.S. Pat. No. 5,216,769, to Eakin. The Martinmaas device is a chair having a number of audio quality speakers located therein. The Komatsubara reference teaches a compact, portable chair having speakers built therein. Finally, the Eakin reference discloses a foldable bed having speakers built therein. Again, it is apparent from this second group of references that they do not address the problem of the present invention, namely the problem of how to add vibratory sensation to a reproduced performance.

Still another group of references teaches the use of transducers in contact with portions of the human body to conduct sound. One of these references, namely U.S. Pat. No. 4,322,585, to Liautaud, teaches the use of a transducer which is placed in contact with the bone to transmit sound. However, the Liautaud reference does not recreate the sensation of a live audible performance on the body, but rather merely uses a portion of the body to transmit sound. Similarly, the other reference in this group, U.S. Pat. No. 5,054,079 to Frielingsdorf et al., teaches the use of bone to conduct sound, this time from the body to a microphone.

Another group of references is illustrated by U.S. Pat. No. 4,635,287, to Hirano, U.S. Pat. No. 4,829,581, to Nieuwendijk et al., and U.S. Pat. No. 5,125,033, to Lee. The Hirano, Nieuwendijk al., and Lee references teach transducers for use in applications similar to those discussed above. The Hirano reference discloses a transducer for installation in the back of a seat, for example, and only reproduces low frequencies. The Nieuwendijk et al. reference describes a transducer for general use. The Lee reference teaches a body sense speaker for contact with the body in applications like a seat, a vest, or a belt. The references in this group also do not suggest a solution to the problem addressed by the present application.

Only one reference in the art addresses the problem addressed by the present invention: U.S. Pat. No. 4,064,376, to Yamada. The Yamada reference teaches a sound reproduction system using a speaker mounted away from the listener and a transducer mounted in a chair for providing a vibratory stimulus to the listener as he or she listens to sound reproduced by the remote speaker. Thus, Yamada seeks to enhance the audible sound with vibratory stimulus derived from the sound signal itself.

However, the Yamada reference does not address a key problem identified for the first time and addressed by the present invention. That problem is that sound and electrical signals travel at different speeds. Specifically, sound travels at 1140 feet per second, while electrical signals travel at 984 million feet per second. Thus, even at short listening distances, there is a significant difference in the propagation of sound as compared with the propagation of electrical signals.

Assume that a listener is located only twelve feet from a speaker producing an audible sound, and has the Yamada system used to provide a vibratory stimulus from the recorded sound signals. In this case, the vibratory signal will arrive earlier than the audible signals by one one-hundredth (0.01) of a second. This difference in timing is easily noticed by a human listener, who can sense the difference in the arrival times of sound waves at his or her ears which are less than one foot apart, or less than one thousandth (0.001) of a second apart. This ability is utilized to identify the direction of a sound source, and is commonly used in stereo systems. The lack of synchrony in the vibration produces a perceived irritation similar to the visual irritation of watching a movie in which the lips are not closely synchronized with the dialogue. Thus, the Yamada reference, while still representing an improvement over the art, is not without a significant defect which will prevent the Yamada system from achieving the effects of a live performance.

It is accordingly the primary objective of the apparatus and method of the present invention that they produce a vibratory sensation affecting the listener which is properly synchronized with the audible sound heard by the listener to thereby produce a result which is perceived as pleasing. In this regard, it is a related objective that the apparatus and method of the present invention allow the precise matching of the vibration and the audible sound at varying distances between the source of the audible sound and the listener, thereby allowing the listener to customize the result to fit any possible situation or location. This variable coupling of the propagation times of the sound between the sound source and the ears of the listener on the one hand and the vibration supplied to the listener's body on the other hand must be easily adjustable by the listener to allow custom tailoring of the system and method of the present invention to fit a wide variety of different ambient conditions and locations.

It is a further objective of the present invention that it provide an enhanced degree of coupling between a transducer producing the vibratory sensation and the portion(s) of the human body being stimulated. As such, it is an objective that the device and method of the present invention provide stimulation to a wide area of the human body to avoid a sensation of only a small area of the human body being prodded or otherwise unnaturally stimulated. Specifically, it is an objective of the present invention that it stimulate a sufficiently large area of the human body to realistically simulate the vibratory stimulation of a live performance on the human body. Tests of the present invention have established that an area on the order of half of the span of the human body area generally to be contacted should be closely coupled to the vibratory stimulation for best results. It is thus a related objective that the preset invention have an enhanced degree of coupling between the transducer and the human body of a character not found in the art, where vibrating chairs otherwise proliferate.

A particular benefit of the apparatus should be to provide the "feeling" of music, which many others have tried to achieve, sometimes through the use of excessive acoustic levels which can cause hearing loss, thereby permanently damaging the ears in some cases.

The vibratory producing and coupling apparatus of the present invention must also be of construction which is both durable and long lasting, and it should also require little or no maintenance to be provided by the user throughout its operating lifetime. In order to enhance the market appeal of the vibratory producing and coupling apparatus of the present invention, it should also be of inexpensive construction to thereby afford it the broadest possible market. Finally, it is also an objective that all of the aforesaid advantages and objectives of the apparatus and method of the present invention be achieved without incurring any substantial relative disadvantage.

SUMMARY OF THE INVENTION

The disadvantages and limitations of the background art discussed above are overcome by the present invention. With this invention, two highly significant enhancements are made over the art, First, the propagation of vibrations to the body of the listener are delayed to allow the sound to reach the ears of the listener at the same time that the vibrations are provided to the body of the listener. Second, the vibrations are imparted to the body of the listener using an enhanced degree of coupling between the transducer and a relatively larger area of the listener's body.

In the preferred embodiment, a rigid or semi-rigid member is driven by a surface transducer mounted on one side thereof. The surface transducer, when connected to a source of electrical signals, will vibrate and will cause the rigid member on which it is mounted to vibrate as well. In the preferred embodiment of the present invention, the rigid member is of a size which is sufficient to cover a significant portion of a body surface which the rigid member is to be placed adjacent to.

The side of the rigid member opposite the side on which the surface transducer is mounted has a coupling element located thereon. The coupling element is designed to be capable of conforming to a body surface when the rigid member is placed against the body surface. In the preferred embodiment, a gel pack, which is gel packaged between two layers of plastic, is used as the coupling element. Pockets of the gel are each individually sealed between the two layers of plastic in a rectangular honeycomb fashion.

Thus, when the rigid member is located adjacent the body surface with the gel pack located intermediate the rigid member and the body surface, the gel pack will conform to the surface of the body to ensure good contact between the rigid member and the body surface. In this manner, when the surface transducer causes the rigid member to vibrate, the vibrations will be transmitted through the gel pack to the body surface that the rigid member is located adjacent to. Instead of the gel pack, any other conforming material could be used instead, such as, for example, a high density elastomeric foam material.

In a first embodiment, two of the rigid members may be used, with each rigid member having a surface transducer mounted on one side thereof, and each rigid member having a gel pack mounted on the other side thereof. The two rigid members may be placed on a chair, for example, with an individual then sitting on the chair. One of the rigid members will then be adjacent the individual's back, with the individual sitting on the other rigid member. In this manner, the two rigid members will each contact large surface areas of the individual's body surface.

In another embodiment, rigid members may also be located on armrests and on a footrest (in addition to the two aforementioned locations), to contact additional body surfaces of the individual. In still another embodiment, a rigid member may be located in a garment such as a vest, which is then worn by an individual. In this embodiment, the individual is ambulatory and need not remain in a single location.

The second aspect of the vibratory producing and coupling device and method of the present invention is that electronic circuitry is used to synchronize audible sounds with the vibratory signals transmitted from the surface transducer to the rigid member, and then to the individual through the gel pack. A source of sound signals has the sound signals provided both to one or more speakers (which are not part of the present invention), and to the electronic circuitry of the present invention.

The electronic circuitry of the preferred embodiment first conditions the signal, typically by passing only the lower frequencies. In the preferred embodiment, frequencies below approximately 200 Hertz are used. The signal is then delayed for a variable period of time which is sufficient to ensure that the vibrations reach the individual whose body is in contact with the vibratory producing and coupling device of the present invention at the same time that the audible sound from the speakers reaches the ears of the individual. Thus, the amount of delay may be adjusted according to the distance that the individual is from the speakers—the greater the distance from the speakers, the greater the delay that is provided for the signal before it transmitted to the vibratory producing and coupling device of the present invention.

After the electronic circuitry of the present invention delays the signal, it is amplified prior to being transmitted to the surface transducer. The amount of amplification is in the preferred embodiment adjustable, to thereby provide different levels of the vibratory sensation, with the individual being able to adjust the resulting level of vibratory stimulation as he or she wishes. This completes the basic embodiment of the circuitry, which is used to drive one or more surface transducers.

In an alternate embodiment, different transducers may be driven by different audio signals. Thus, for example, right and left channels of a stereo signal may be used to drive surface transducers which vibrate rigid members located close adjacent to different sides of the individual. For example, armrests for the right and left arms of the individual may be driven by the right and left channels of a stereo signal, respectively.

In one alternate embodiment, different surface transducers may each have different control circuits operating them, from either the same audio signal or from different audio signals. By adjusting the controls on each of the control systems, different surface transducers may be driven by different frequency bands, with different delays, and/or with different amplitudes. It will be appreciated that a number of different combinations are readily available for use by those skilled in the art.

It may therefore be seen that the present invention teaches an apparatus and method that produce a vibratory sensation on the listener which is properly synchronized with the audible sound heard by the listener, thereby producing an aurally pleasing result. Specifically, the apparatus and method of the present invention allow the precise matching of the vibration with the audible sound at varying distances between the source of the audible sound and the listener, thereby allowing the listener to customize the result to fit any possible situation or location. This variable coupling of the propagation times of the sound between the sound source and the ears of the listener on the one hand and the vibration supplied to the listener's body on the other hand is easily adjustable by the listener to allow custom tailoring of the system and method of the present invention to fit a wide variety of different ambient conditions and locations.

The vibratory producing and coupling apparatus and method of the present invention provide an enhanced degree of coupling between the transducer producing the vibratory sensation and the portion(s) of the human body being stimulated. As such, the vibratory producing and coupling device and method of the present invention provide stimulation to a wide area of the human body, thereby avoiding the sensation of only a small area of the human body being prodded or otherwise unnaturally stimulated. Specifically, the vibratory producing and coupling device and method of the present invention stimulate a sufficiently large area of the human body to realistically simulate the vibratory stimulation of a live performance on the human body. Thus, the vibratory producing and coupling device and method of the preset invention have an enhanced degree of coupling between the transducer and the human body of a character not found in the vibrating chair art.

The vibratory producing and coupling apparatus of the present invention are also of construction which is both durable and long lasting, and which should require little or no maintenance to be provided by the user throughout its operating lifetime. The vibratory producing and coupling apparatus of the present invention is also of inexpensive construction to thereby afford it the broadest possible market. Finally, all of the aforesaid advantages and objectives of the apparatus and method of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

In a first major improvement over the art, particularly over the Yamada reference, the preferred embodiment of the present invention utilizes electronic circuitry to allow an adjustable degree of delay to be imposed on the electronic signal which is to be used to drive the transducer used to impart vibratory stimulation to the body of a listener, thereby allowing time for the sound coming from one or more speakers to reach the listener's ears at the same time the vibratory stimulations reach the listener's body. The second major improvement of the present invention is the mechanism which is used to couple the vibrations generated by the transducer to the listener's body.

Figure 1:
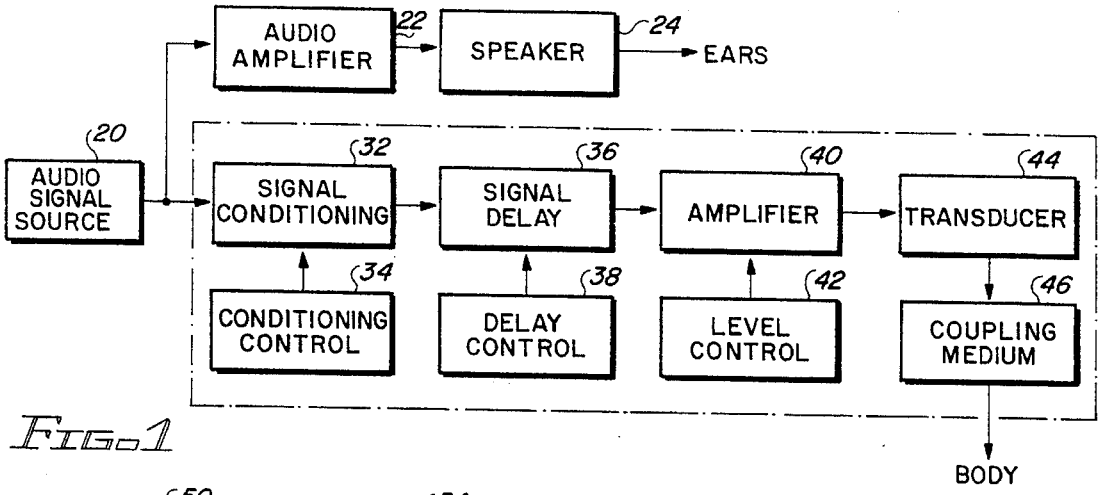
FIG. 1 is a schematic block diagram of the vibratory producing and coupling device of the present invention, showing it driven by an audio signal source, which also operates a speaker through an amplifier, and also showing the circuitry used to condition, delay, and amplify the audio signal prior to supplying it to a transducer, which provides vibratory signals to a body (not shown) through a coupling medium, with the circuitry, the transducer, and the coupling medium together comprising a vibratory processing, producing, and coupling device.

Referring first to FIG. 1, a schematic block diagram illustrates how the first major improvement is implemented by the present invention. An audio signal source 20 provides electronic signals which are representative of audible sounds. The audio signal source 20 may be any of a wide variety of sources, such as a CD player, a tape recorder, or a magnetic disc, for example. The electronic signals are supplied by the audio signal source 20 to an audio amplifier 22, which is conventional in the art, and which amplifies the electronic signals to a level suitable to be supplied to a speaker 24. The speaker 24 generates sound waves which are audible to the ears of a listener from the amplified electronic signals which are provided by the audio amplifier 22 to the speaker 24. As such, the audio signal source 20, the audio amplifier 22, and the speaker 24 are of conventional design in the art.

The electronic signals which are representative of audible sounds are also supplied to a vibratory signal processing, producing, and coupling device 30, which produces vibratory signals which are coupled to the body of the listener. The vibratory signal processing, producing, and coupling device 30 contains a number of components which are used to process the electronic signals, to transduce the electronic signals into vibratory stimulations, and to efficiently and effectively couple these vibratory stimulations to the body of the listener. In conjunction with FIG. 1, the discussion will center around the first two of these three functions.

The electronic signals from the audio signal source 20 are thus supplied to signal conditioning circuitry 32, which functions to select the portions of the electronic signals which are to be utilized by the vibratory signal processing producing, and coupling device 30, with the other portions of the electronic signals being discarded. In the preferred embodiment, the signal conditioning circuitry 32 includes a low pass filter, passing signals under approximately 200 Hertz, and rejecting the higher frequency signals. A conditioning control 34 may be used in the preferred embodiment to adjust the characteristics of the signal conditioning circuitry 32 to vary the frequency below which the electronic signals will be passed.

The low passed electronic signals are supplied from the signal conditioning circuitry 32 to a signal delay circuit 36, which is the heart of the first aspect of the present invention. The signal delay circuit 36 passes the low passed electronic signals, but only after delaying them for a preselected amount of time. The signal delay circuit 36 may be a bucket brigade-type of delay circuit, which is well known to those skilled in the art. The amount of delay imposed by the signal delay circuit 36 is controlled and adjusted by a delay control 38, which may if desired be calibrated in units of distance to allow the listener to easily adjust the delay control 38 to correspond to the distance between the speaker 24 and the listener.

The delayed, low passed electronic signals are supplied by the signal delay circuit 36 to an amplifier 40, where the signals are amplified. The amount of amplification provided by the amplifier 40 is adjustable in the preferred embodiment, and may be controlled by a level control 42.

The amplified, delayed, low passed electronic signals are supplied by the amplifier 40 to a transducer 44, where they are converted into vibratory stimulations. The vibratory stimulations are coupled from the transducer 44 to the body of the listener through a coupling medium 46. The details of the transducer 44 and the coupling medium 46 as utilized by the preferred embodiment of the present invention relate to the second aspect of the present invention, and as such they will be discussed in greater detail below.

It will, however, be appreciated by those skilled in the art from the discussion of FIG. 1 that the deficiency of the Yamada reference is addressed and eliminated by the present invention. Through the imposition of the delay by the signal delay circuit 36 of the vibratory signal processing, producing, and coupling device 30, the audible sounds from the speaker 24 will reach the ears of the listener simultaneously with the vibratory signals from the transducer 44.

Figure 2:
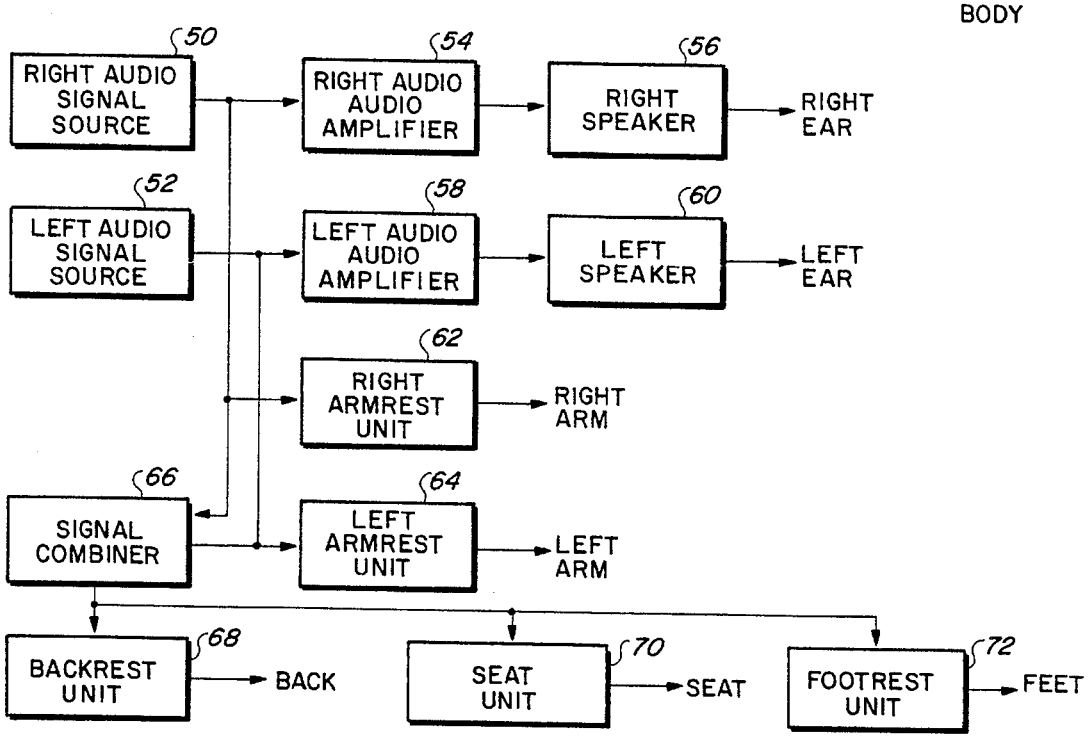
FIG. 2 is a schematic block diagram similar to the diagram illustrated in FIG. 1, but with right and left audio signal sources used to drive right and left speakers, respectively, through right and left amplifiers, respectively, and also showing the right and left audio signals being used to drive vibratory processing, producing, and coupling devices for right and left armrests, respectively, and also showing the right and left signals being combined and used to drive three vibratory processing, producing, and coupling devices which are used to generate vibratory signals which are provided to a backrest, a seat, and a footrest, respectively.
Figure 4:
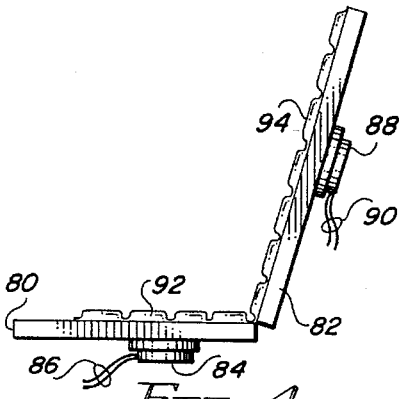
FIG. 4 is a side view of the transducer and the coupling medium illustrated in FIG. 3, again showing the gel pack material installed on the front of the seat back member and the top side of the seat base member, and also showing a surface transducer mounted on the back side of the seat back member and another surface transducer mounted on the bottom side of the seat base member.
Figure 5:
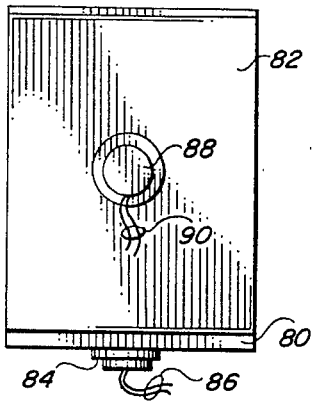
FIG. 5 is a back plan view of the transducer and the coupling medium illustrated in FIGS. 3 and 4, showing the central location of the surface transducer located on the back side of the seat back member.
Figure 6:
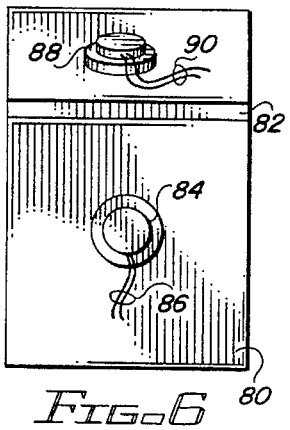
FIG. 6 is a bottom plan view of the transducer and the coupling medium illustrated in FIGS. 3 and 4, showing the central location of the surface transducer located on the bottom side of the seat base member.
Figure 3:
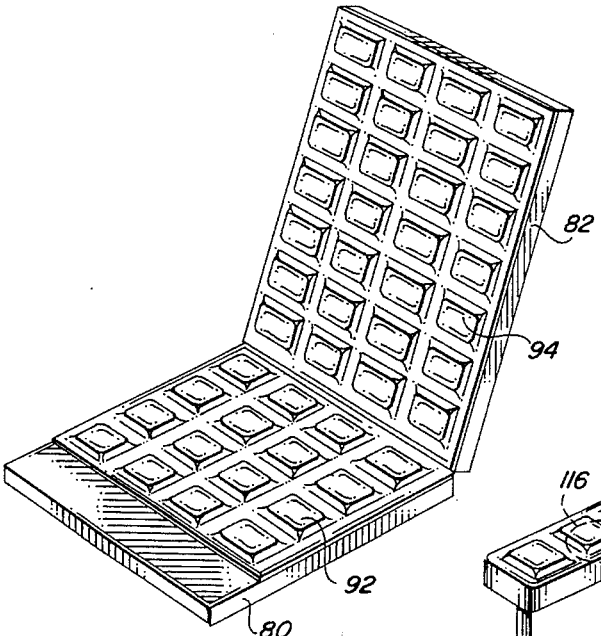
FIG. 3 is a perspective view of the preferred embodiment of the transducer and the coupling medium, showing a seat base member and a seat back member which are each rigid members, and also showing a segment of gel pack material installed on the front of the seat back member and another segment of gel pack material installed on the top side of the seat base member.

Referring next to FIG. 2, the system of FIG. 1 is shown enhanced in several different aspects thereof. First, instead of the single audio signal source 20, the system of FIG. 2 utilizes a right audio signal source 50 and a left audio signal source 52. The right audio signal source 50 supplies electronic signals to a right audio amplifier 54, which amplifies the electronic signals prior to supplying them to a right speaker 56, which generates sound waves to be provided primarily to the right ear of a listener. Similarly, the left audio signal source 52 supplies electronic signals to a left audio amplifier 58, which amplifies the electronic signals prior to supplying them to a left speaker 60, which generates sound waves to be provided primarily to the left ear of a listener.

The second aspect in which the system of FIG. 2 is different from the system of FIG. 1 is that the system of FIG. 2 utilizes a plurality of the vibratory signal processing, producing, and coupling devices, each of which is individually adjustable. In a third and related aspect, one of the vibratory signal processing, producing, and coupling devices is driven by electronic signals supplied solely from the right audio signal source 50, another of the vibratory signal processing, producing, and coupling device is driven by electronic signals supplied solely from the left audio signal source 52, while still other vibratory signal processing, producing, and coupling devices are driven by the combined electronic signals from the right audio signal source 50 and the left audio signal source 52. All of the vibratory signal processing, producing, and coupling devices are substantially similar in construction and operation to the vibratory signal processing, producing, and coupling device 30 of FIG. 1, except perhaps in the configuration of the coupling media used by the vibratory signal processing, producing, and coupling devices.

Specifically, the electronic signals from the right audio signal source 50 are used to drive a right armrest vibratory signal processing, producing, and coupling device 62, while the electronic signals from the left audio signal source 52 are used to drive a left armrest vibratory signal processing, producing, and coupling device 64. The electronic signals from the right audio signal source 50 and the left audio signal source 52 are combined in a signal combiner 66, with the combined electronic signals being used to drive a backrest vibratory signal processing, producing, and coupling device 68, a seat bottom vibratory signal processing, producing, and coupling device 70, and a footrest vibratory signal processing, producing, and coupling device 72.

Referring next to FIGS. 3 through 6, the transducer 44 and the coupling medium 46 of the vibratory signal processing, producing, and coupling device 30 of FIG. 1 are illustrated in their exemplary implementations. The coupling medium preferably contacts at least half of the local body width of the body of the listener. A seat base member 80 and a seat back member 82 are each made of relatively rigid material, and are relatively sized and contoured to accommodate the body of a listener thereon. Centrally mounted on the bottom side of the seat base member 80 is a surface transducer 84 having a pair of wires 86 extending therefrom. Centrally mounted on the back side of the seat back member 82 is a surface transducer 88 having a pair of wires 90 extending therefrom.

The surface transducers 84 and 88 in the preferred embodiment are surface audio transducers such as the SFT-1 surface transducer made by BSR Audio Equipment. They correspond to the transducer 44 of the vibratory signal processing, producing, and coupling device 30 as illustrated in FIG. 1. The pairs of wires 86 and 90 are connected to the amplifier 40 of the vibratory signal processing, producing, and coupling device 30 to drive the surface transducer 84 and the surface transducer 88.

Mounted on the top side of the seat base member 80 is a segment of gel pack material 92. Mounted on the front side of the seat back member 82 is a segment of gel pack material 94. The segment of gel pack material 92 and the segment of gel pack material 94 are segments of gel pack material such as the cold/hot pack ensemble made by Flexoversal. This material consists of a pair of sheets of flexible plastic material with pouches of viscous gel material located in a rectangular grid matrix typically formed by heat sealing boundaries between the pouches of gel. The segment of gel pack material 92 and the segment of gel pack material 94 correspond to the coupling medium 46 of the vibratory signal processing, producing, and coupling device 30 in FIG. 1.

In operation, the seat illustrated in FIGS. 3 through 6 and the system illustrated in FIG. 1 may be referenced together. Electronic signals supplied by the audio signal source 20 are amplified by the audio amplifier 22 and converted to sound waves by the speaker 24. The electronic signals from the audio signal source 20 are also supplied to the signal conditioning circuitry 32, where they are conditioned (typically by low pass filtering them). The low passed electronic signals are supplied from the signal conditioning circuitry 32 to the signal delay circuit 36, where they are delayed by an appropriate amount of time to allow the sound waves from the speaker 24 to reach the ears of the listener at the same time vibrations resulting from the delayed, low passed electronic signals reach the listener's body.

The delayed, low passed electronic signals are amplified by the amplifier 40, with the amplified, delayed, low passed electronic signals then being supplied to the surface transducer 84 and the surface transducer 88. The surface transducer 84 and the surface transducer 88 then generate vibrations corresponding to these electronic signals, which vibrations are transmitted to the seat base member 80 and the seat back member 82, respectively. Vibrations from the seat base member 80 are coupled through the segment of gel pack material 92 to the portion of the listener's body resting on the seat base member 80, while vibrations from the seat back member 82 are coupled through the segment of gel pack material 94 to the portion of the listener's body resting against the seat back member 82

Due to the time delay imposed by the signal delay circuit 36, the vibrations will be synchronized precisely with the sound waves from the speaker 24, resulting in a greatly enhanced "feel" to the sounds heard by the listener.

Figure 7:
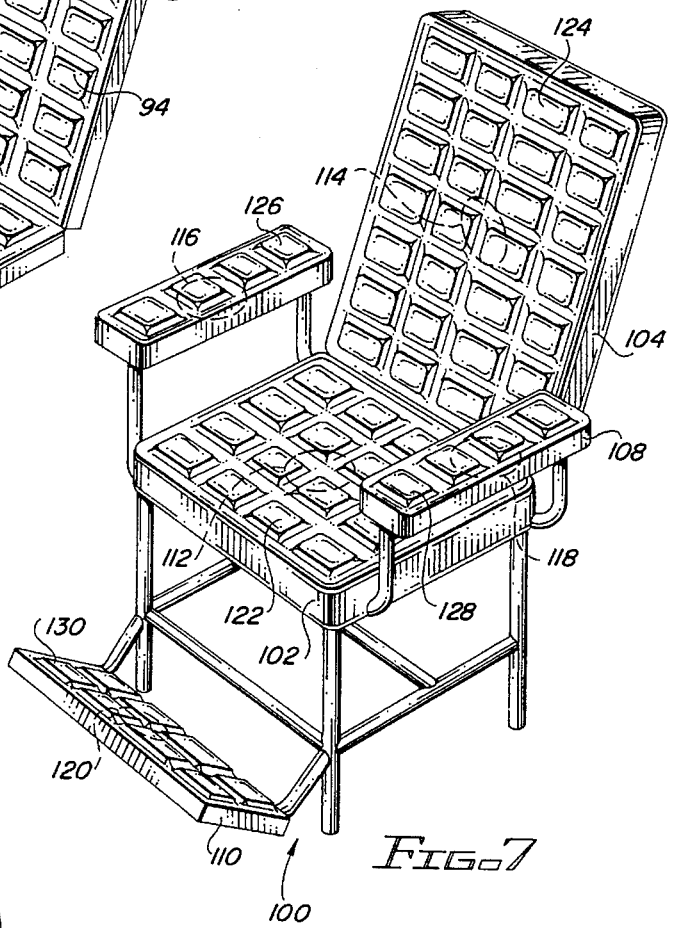
FIG. 7 is a perspective view of a chair having multiple sets of transducers and coupling media, with such sets being located on the seat base member, the seat back member, the right and left armrests, and the footrest of the chair, with the sets of transducers and coupling media on the chair of FIG. 7 being operable in the manner illustrated above in FIG. 2.

Referring next to FIG. 7, the transducers and the coupling media of the right armrest vibratory signal processing, producing, and coupling device 62, the left armrest vibratory signal processing, producing, and coupling device 64, the backrest vibratory signal processing, producing, and coupling device 68, the seat bottom vibratory signal processing, producing, and coupling device 70, and the footrest vibratory signal processing, producing, and coupling device 72 of FIG. 2 are illustrated in their exemplary implementations as installed on a chair 100. The chair 100 has a seat base member 102, a seat back member 104, a right armrest member 106, a left armrest member 108, and a footrest member 110.

The surface transducers are all shown in phantom lines in FIG. 7. Mounted on the bottom side of the seat base member 102 is a surface transducer 112. Mounted on the back side of the seat back member 104 is a surface transducer 114. Mounted on the bottom side of the right armrest member 106 is a surface transducer 116. Mounted on the bottom side of the left armrest member 108 is a surface transducer 118. Mounted on the bottom side of the footrest member 110 is a surface transducer 120. The surface transducers 112, 114, 116, 118, and 120 correspond to the transducer 44 of the vibratory signal processing, producing, and coupling device 30 illustrated in FIG. 1, which is identical to each of the five vibratory signal processing, producing, and coupling devices 62, 64, 68, 70, and 72 illustrated in FIG. 2.

Mounted on the top side of the seat base member 102 is a segment of gel pack material 122. Mounted on the front side of the seat back member 104 is a segment of gel pack material 124. Mounted on the top side of the right armrest member 106 is a segment of gel pack material 126. Mounted on the top side of the left armrest member 108 is a segment of gel pack material 128. Mounted on the top side of the footrest member 110 is a segment of gel pack material 130. The segments of gel pack material 122, 124, 126, 128, and 130 correspond to the coupling medium 46 of the vibratory signal processing, producing, and coupling device 30 illustrated in FIG. 1, which is identical to each of the five vibratory signal processing, producing, and coupling devices 62, 64, 68, 70, and 72 illustrated in FIG. 2.

Figure 8:
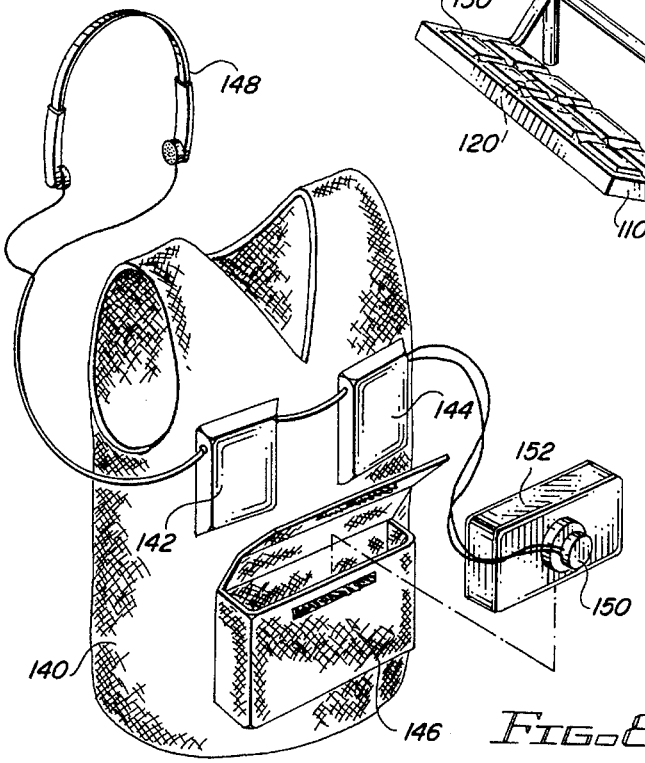
FIG. 8 is a front plan view of a vest having two small pockets and a large pocket, with one of the small pockets containing an audio source, the other small pocket containing the processing circuitry used to condition, delay, and amplify the signal from the audio source, and with the large pocket used to contain a rigid member having a surface transducer mounted thereon.

Referring finally to FIG. 8, a vest 140 is illustrated which has three pockets 142, 144, and 146 located in the front side thereof. The pocket 142 is a small beast pocket on the right side of the vest (as worn). The pocket 144 is a small breast pocket on the left side of the vest (as worn). The pocket 146 is a larger pocket centrally located below the pockets 142 and 144.

The pocket 142 may hold a source of amplified electronic signals, such as a small portable radio, tape player, CD player, or MiniDisc player, all of which are conventional in the art. This device, which is not visible in FIG. 8, is analogous to the audio signal source 20 and the audio amplifier 22 of FIG. 1. The device may be used to drive a pair of headphones 148, which are analogous to the speaker 24 of FIG. 1.

The device in the pocket 142 may also drive circuitry located (but not visible in FIG. 8) in the pocket 144. This circuitry would include the signal conditioning circuitry 32, the signal delay circuit 36, and the amplifier 40 (all shown in FIG. 1), as well as the controls therefor (the conditioning control 34, the delay control 38, and the level control 42, respectively, all also shown in FIG. 1). The amplified, delayed, low passed electronic signals from the circuitry located in the pocket 144 would drive a surface transducer 150, which is mounted on a semi-rigid segment 152 which is made of high density foam or a similar material. The semi-rigid segment 152, which will be placed in the pocket 146 together with the surface transducer 150, thus acts as the coupling medium 46 of FIG. 1.

It may therefore be appreciated from the above detailed description of the preferred embodiment of the present invention that it teaches an apparatus and method that produce a vibratory sensation on the listener which is properly synchronized with the audible sound heard by the listener, thereby producing an aurally pleasing result. Specifically, the apparatus and method of the present invention allow the precise matching of the vibration with the audible sound at varying distances between the source of the audible sound and the listener, thereby allowing the listener to customize the result to fit any possible situation or location. This variable coupling of the propagation times of the sound between the sound source and the ears of the listener on the one hand and the vibration supplied to the listener's body on the other hand is easily adjustable by the listener to allow custom tailoring of the system and method of the present invention to fit a wide variety of different ambient conditions and locations.

The vibratory producing and coupling apparatus and method of the present invention provide an enhanced degree of coupling between the transducer producing the vibratory sensation and the portion(s) of the human body being stimulated. As such, the vibratory producing and coupling device and method of the present invention provide stimulation to a wide area of the human body, thereby avoiding the sensation of only a small area of the human body being prodded or otherwise unnaturally stimulated. Specifically, the vibratory producing and coupling device and method of the present invention stimulate a sufficiently large area of the human body to realistically simulate the vibratory stimulation of a live performance on the human body. Thus, the vibratory producing and coupling device and method of the preset invention have an enhanced degree of coupling between the transducer and the human body of a character not found in the vibrating chair art.

The vibratory producing and coupling apparatus of the present invention are also of construction which is both durable and long lasting, and which should require little or no maintenance to be provided by the user throughout its operating lifetime. The vibratory producing and coupling apparatus of the present invention is also of inexpensive construction to thereby afford it the broadest possible market. Finally, all of the aforesaid advantages and objectives of the apparatus and method of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A system for producing vibratory sensations to accompany sound waves generated in response to electronic signals supplied by an audio signal source, which sound waves are heard by a listener, said system comprising:

a signal delay circuit having the electronic signals as an input thereto, said signal delay circuit being operational to delay said electronic signals for a preselected amount of time, said signal delay circuit thereby producing as an output delayed electronic signals;

an amplifier having said delayed electronic signals as an input thereto, said amplifier amplifying said delayed electronic signals, said amplifier thereby producing as an output amplified, conditioned electronic signals;

a transducer having said amplified, delayed electronic signals as an input thereto, said transducer producing vibratory stimulations in response to said amplified, delayed electronic signals;

means for coupling said vibratory stimulations produced by said transducer to the body of the listener;

a second signal delay circuit having second electronic signals from a second audio signal source as an input thereto, said second signal delay circuit being operational to delay said second electronic signals for a preselected amount of time, said second signal delay circuit thereby producing as an output second delayed electronic signals;

a second amplifier having said second delayed electronic signals as an input thereto, said second amplifier amplifying said second delayed electronic signals, said second amplifier thereby producing as an output second amplified, conditioned electronic signals;

a second transducer having said second amplified, delayed electronic signals as an input thereto, said second transducer producing second vibratory stimulations in response to said second amplified, delayed electronic signals; and second means for coupling said second vibratory stimulations produced by said second transducer to the body of the listener at a location on the body of the listener different from the location at which vibratory stimulations produced by said transducer are coupled to the body of the listener.

2. A system as defined in claim 1, additionally comprising:

means for combining the electronic signals from the audio signal source and the second electronic signals from the second audio signal source;

a third signal delay circuit having combined electronic signals from said combining means as an input thereto, said third signal delay circuit being operational to delay said combined electronic signals for a preselected amount of time, said third signal delay circuit thereby producing as an output third delayed electronic signals;

a third amplifier having said third delayed electronic signals as an input thereto, said third amplifier amplifying said third delayed electronic signals, said third amplifier thereby producing as an output third amplified, conditioned electronic signals;

a third transducer having said third amplified, delayed electronic signals as an input thereto, said third transducer producing third vibratory stimulations in response to said third amplified, delayed electronic signals; and third means for coupling said third vibratory stimulations produced by said third transducer to the body of the listener at a location on the body of the listener different from the locations at which vibratory stimulations produced by said transducer and said second transducer are coupled to the body of the listener.

* * * * *